United States Patent [19]

Seki et al.

[11] Patent Number: 4,843,933

[45] Date of Patent: Jul. 4, 1989

[54] APPARATUS FOR DETERMINING POSITIONS OF HEADS

[75] Inventors: Yukuharu Seki; Yukio Oku, both of Hiroshima, Japan

[73] Assignee: Mitsubishi Jukogyo Kabushiki Kaisha, Tokyo, Japan

[21] Appl. No.: 105,384

[22] PCT Filed: Jan. 27, 1987

[86] PCT No.: PCT/JP87/00051

§ 371 Date: Oct. 13, 1987

§ 102(e) Date: Oct. 13, 1987

[87] PCT Pub. No.: WO87/04384

PCT Pub. Date: Jul. 30, 1987

[30] Foreign Application Priority Data

Jan. 27, 1986 [JP] Japan ..... 61-15080

[51] Int. Cl.[4] ..... B26D 1/24

[52] U.S. Cl. ..... 83/508.3; 83/499

[58] Field of Search ..... 83/499, 498, 501, 504, 83/508.2, 508.3, 507, 425.3, 425.4

[56] References Cited

U.S. PATENT DOCUMENTS

| | | | |
|---|---|---|---|
| 3,587,374 | 6/1971 | Stewart et al. | 83/499 |
| 3,646,418 | 2/1972 | Sterns et al. | 83/499 |
| 3,750,513 | 8/1973 | Cromeens | 83/499 |
| 3,882,764 | 5/1975 | Johnson | 83/499 |
| 4,010,677 | 3/1977 | Hirakawa et al. | 83/499 |
| 4,033,217 | 7/1977 | Flaum et al. | 83/425.4 |
| 4,162,643 | 7/1979 | Coburn | 83/499 |
| 4,224,847 | 9/1980 | Tokuno | 83/499 |
| 4,283,981 | 8/1981 | Trautmann | 83/499 |
| 4,316,317 | 2/1982 | Ritzling | 83/499 |
| 4,516,454 | 5/1985 | Mosburger | 83/499 |

FOREIGN PATENT DOCUMENTS

| | | |
|---|---|---|
| 52-109682 | 9/1977 | Japan . |
| 57-50667 | 10/1982 | Japan . |
| 58-51000 | 11/1983 | Japan . |
| 1402778 | 8/1975 | United Kingdom . |

*Primary Examiner*—Frank T. Yost
*Assistant Examiner*—Scott A. Smith
*Attorney, Agent, or Firm*—Bernard, Rothwell & Brown

[57] ABSTRACT

An apparatus for determining positions of a plurality of heads in accordance with the present invention is employable for a slitter scorer on a corrugate machine for cutting or scoring a sheet of paper board. The apparatus of the invention is so constructed that each of heads slidably disposed on a shaft is located at a voluntary position on the shaft by repeating the operational steps of displacing the heads as a group of at least more than two heads by pushing them from the rear side with the use of substantially single shifter adapted to move in parallel with the shaft and parting away from the shifter one head at the rearmost end among the moving heads when the shifter reaches a predetermined position, wherein the apparatus is provided with means for limiting forward displacing of a head at the foremost end among the heads which are displaced by means of the shifter.

2 Claims, 4 Drawing Sheets

APPARATUS FOR DETERMINING POSITIONS OF HEADS

TECHNICAL FIELD

The present invention relates to an apparatus for determining positions of a plurality of heads which is employable for a slitter scorer on a corrugate machine.

BACKGROUND OF TECHNIQUE

An example of a conventional slitter scorer on a corrugate machine for cutting or scoring a sheet of continuously moving cardboard in the direction of movement is shown in FIG. 5.

The apparatus shown in FIG. 5 is an apparatus for determining positions of heads wherein it is so constructed that a plurality of heads 2 are slidably mounted on shafts 1 and 1*a* and each of the heads 2 can be located at a voluntary position on the shafts 1 and 1*a* by repeating the operational steps of displacing the heads 2 on the shafts 1 and 1*a* by means of shifters 3 and 3*a* individually or as a group comprising more than two heads and parting away from the shifters 3 and 3*a* one head at the rearmost end among the heads 2 when the shifters 3 and 3*a* reach a predetermined position (refer to Japanese Publication Patent NO. 50667/1976).

The shifters 3 and 3*a* have screw shafts 5 and 5*a* extended therethrough and the screw shafts 5 and 5*a* are rotatably supported on frames 4 and 4*a*. The screw shafts 5 and 5*a* have sprockets 6 and 6*a* at the one end thereof so that they are rotationally driven by means of a motor 8 via chains 7 and 7*a*. Accordingly, as the screw shafts 5 and 5*a* are rotated, the shifters 3 and 3*a* are displaced on the screw shafts 5 and 5*a* so as to displace the heads 2.

FIGS. 6 and 7 are a cross-sectional view of the apparatus taken in line X—X in FIG. 5 respectively, illustrating the structure of the shifters 3 and 3*a* in different operational states.

The shifters 3 and 3*a* are pivotally provided with arms 9 and 9*a* at both the ends thereof. Air cylinders 10 and 10*a* are pivotally attached to the arms 9 and 9*a* at the one end and abutment plates 11 and 11*a* are fixedly attached to the same at the other end thereof.

As shown in FIG. 6, when the heads 2 are displaced, the air cylinders 10 and 10*a* are actuated and the arms 9 and 9*a* are closed, causing the abutment plates 11 and 11*a* to contact the head 2. Thereafter, the shifters 3 and 3*a* and the head 2 are displaced toward the controlling side A. When the heads 2 reach a predetermined position, rotation of the motor 8 is interrupted and thereby movement of the shifters 3 and 3*a* are interrupted.

Next, the air cylinders 10 and 10*a* are actuated and the arms 9 and 9*a* are opened to assume an inoperative state as shown in FIG. 7. While the arms 9 and 9*a* are kept in the opened state, the shifters 3 and 3*a* are displaced toward the controlling side A by a distance equal to the length of one head 2 and by actuating the air cylinder 10 and 10*a* again, the arms 9 and 9*a* are closed to assume the operative state as shown in FIG. 6. Thus, the shifter 3 and 3*a* displace the heads 2 toward the next predetermined position. By repeating the abovementioned operations, a number of heads 2 are successively located at their predetermined position. Incidentally, operations of the motor 8 and the air cylinders 10 and 10*a* are properly controlled by means of a control unit which is not shown in the drawings.

Since the above-describe slitter scorer is so constructed that the shifter pushes the rearmost end of the heads with the aid of the arm and abutment plate to displace the heads, it is not provided with any stopper for forcibly stopping inertia movement of the heads when the shifter decelerates and stops its movement. Accordingly, to inhibit an occurrence of inertia movement of the heads, arrangement is made such that the shifter decelerates from its high speed moving state, moves at a lower speed at which the heads does not carry out inertia movement, and then stops its movement. As a result, it has been found as problems that it takes long time for movement at a lower speed and setting time is elongated (For instance, in the case where a slitter scorer has a setting range of 2500 mm and includes fourteen heads, about 60 seconds are required as setting time.).

DISCLOSURE OF THE INVENTION

The present invention has been proposed to solve the foregoing problems and its object resides in providing an apparatus for determining positions of heads wherein a shifter is provided with limiting means for limiting forward movement of the foremost head to be displaced in order to prevent an occurrence of inertia movement of the heads, movement of the shifter at a higher speed can be carried out and moreover setting time can be reduced remarkably.

To accomplish the above object, there is proposed according to the present invention an apparatus for determining positions of a plurality of heads slidably disposed on a shaft wherein each of the heads is located at a voluntary position on the shaft by repeating the operational steps of displacing the heads as a group of at least more than two heads by pushing them from the rear side with the use of substantially single shifter adapted to move in parallel with the shaft and parting away from the shifter one head at the rearmost end among the moving heads when the shifter reaches a predetermined position, characterized in that the apparatus is provided with means for limiting forward displacement of a head at the foremost end among the heads which are displaced by means of the shifter. When the shifter pushes a group of heads from the rear side and stops its movement, the aforesaid limiting means limits forward movement of the foremost head and thereby inertia movement of the group of heads can be prevented reliably.

According to another embodiment of the present invention the shifter comprises a support shaft rotatably supported on a shifter housing, a plurality of pushers fitted onto the support shaft corresponding to the heads and including a pawl on the periphery thereof to come in engagement with the head, a carrier comprising a circular plate-shaped limiting means secured to the fore end position of the foremost end head on the support shaft to come in engagement with the head, and rotational means for rotating the support shaft mounted on the shifter housing, wherein the pawls of the pusher have a phase different from one another as seen in the direction of rotation and only one pawl is engageable with the head. When the apparatus of the invention is used, the pawls on the pushers corresponding to the heads to be displaced are indexed at the position where the pawls come in engagement with the heads in order to displace a predetermined number of heads which are gotten together at the one end of the shifter housing, in the opposite direction. Further, the head at the foremost end as seen from the controlling side contacts the circular plate. As the shifter is displaced while the above-mentioned state is maintained, it displaces a group of heads with the aid of the pushers. When the shifter stops its movement at a preset position, the heads tend to overrun under the effect of their inertia movement but overruning is inhibited due to the circular plate located forwardly of the head at the foremost end.

BRIEF DESCRIPTION OF THE DRAWINGS

The present invention will be illustrated in the following drawings.

BEST MODE FOR IMPLEMENTING THE INVENTION

Figure 1:
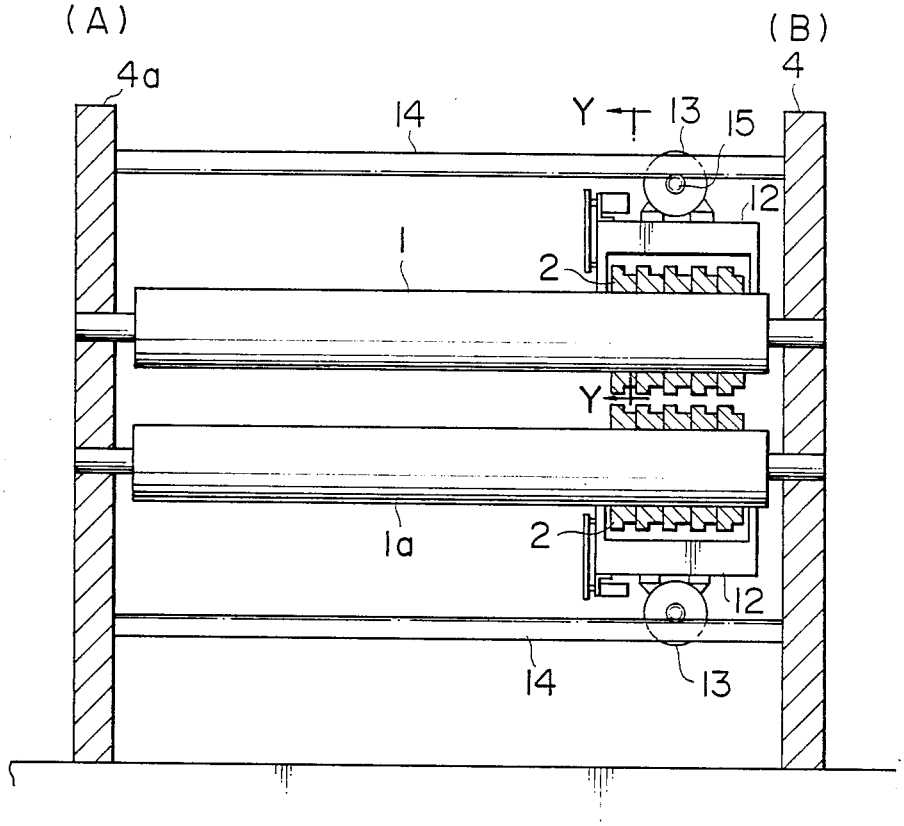
FIG. 1 is a side view of an apparatus for determining positions of heads in accordance with an embodiment of the invention.

Now, the present invention will be described in a greater detail hereunder with reference to FIGS. 1 to 4 which illustrate an embodiment thereof.

In the drawings reference numerals 1 and 1*a* designate a a pair of rotational shaft respectively and both the ends of the shaft 1 and 1*a* are rotatably supported by frames 4 and 4*a*. A number of heads 2 are slidably mounted on the shafts 4 and 4*a*. This embodiment illustrates a case where six heads are mounted on the frames but the present invention should not be limited only to this case. Further, racks 14 and beams 20 of which both ends are fixedly secured to the frames 4 and 4*a* are disposed at the positions upwardly and downwardly of the pair of shafts 1 and 1*a*.

Figure 2:
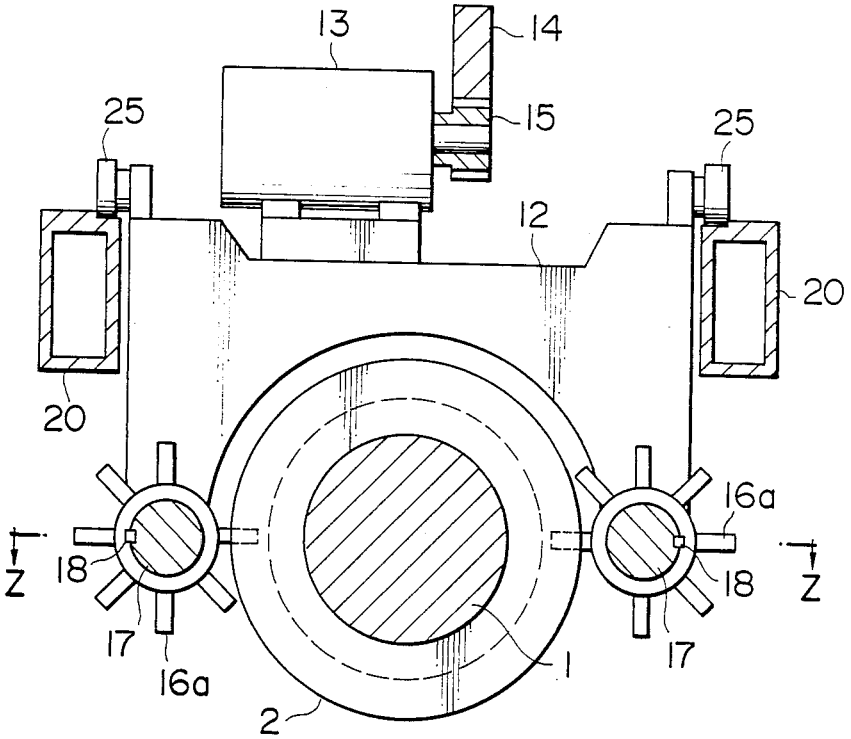
FIG. 2 is a cross-sectional view of the apparatus taken in line Y—Y in FIG. 1.
Figure 3:
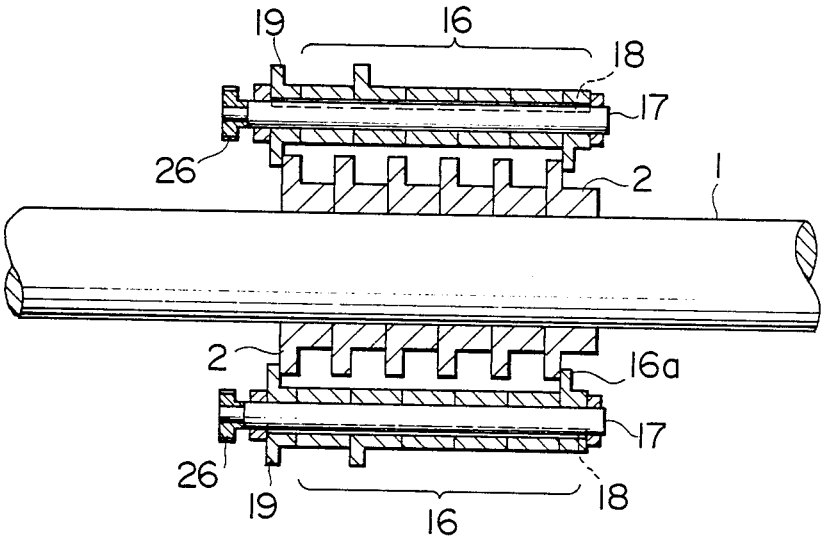
FIG. 3 is a sectional view of the apparatus taken in line Z—Z in FIG. 2.
Figure 4:
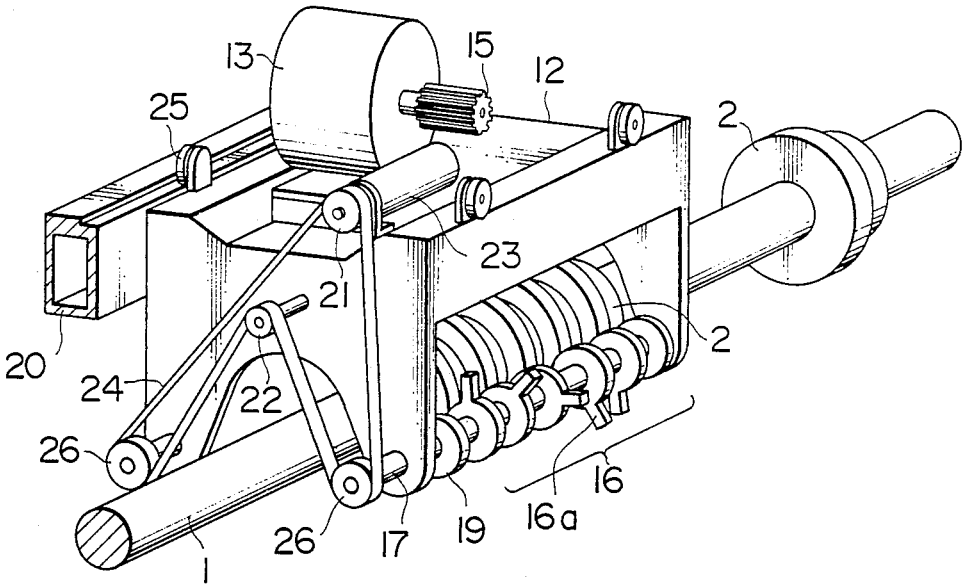
FIG. 4 is a perspective view of the apparatus in FIG. 2.
Figure 6:
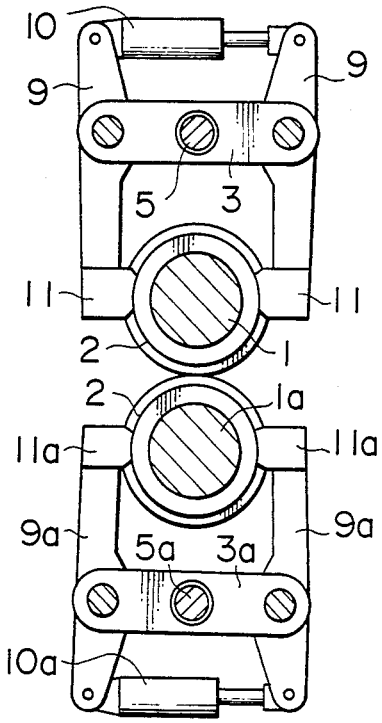
PRIOR ART FIG. 6
FIG. 6 is a cross sectional view of the apparatus taken in line X—X in FIG. 5, particularly illustrating the operative state of a shifter.
Figure 7:
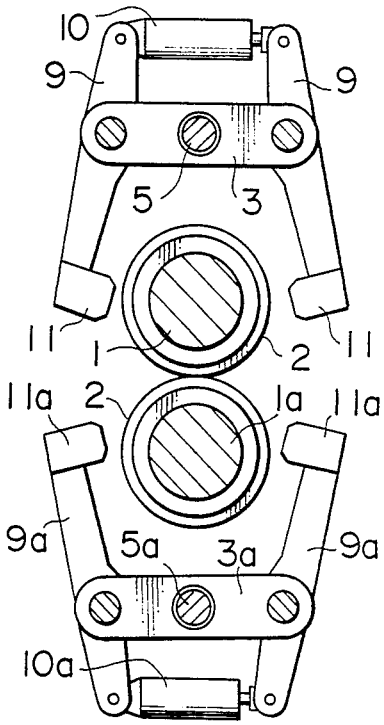
PRIOR ART FIG. 7
FIG. 7 is a cross-sectional view of the apparatus taken in line X—X in FIG. 5, particularly illustrating the inoperative state of the shifter.
Figure 5:
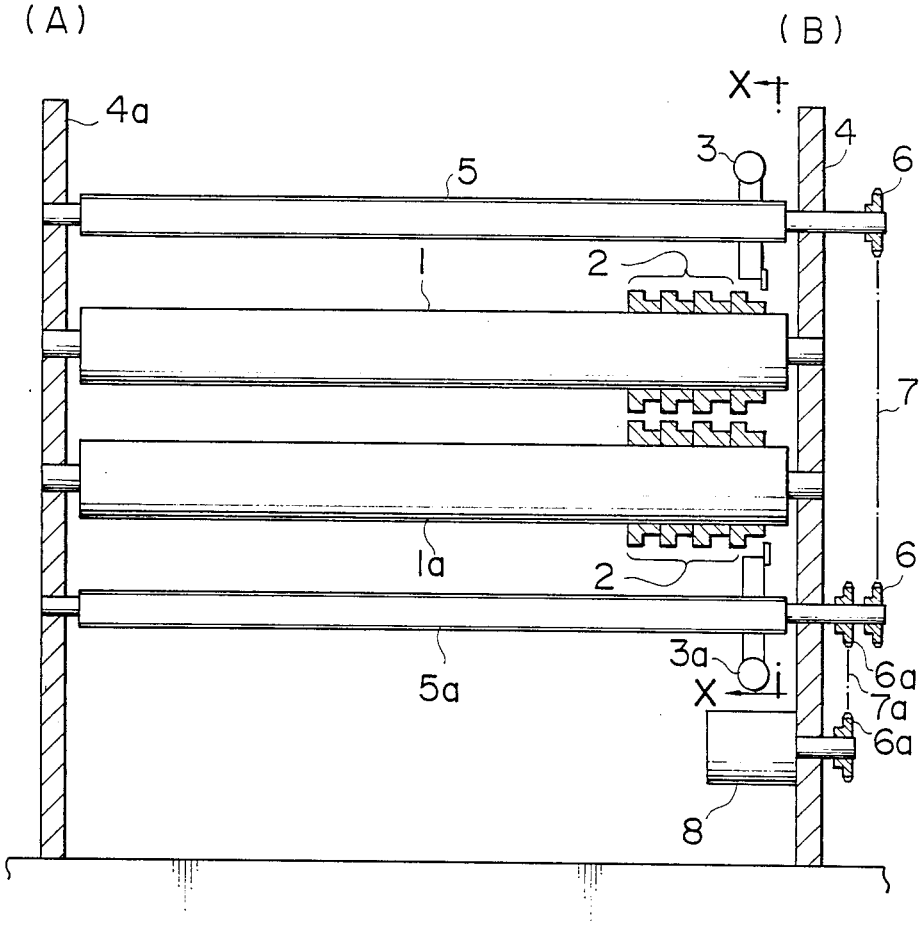
FIG. 5 PRIOR ART
FIG. 5 is a side view of a conventional slitter scorer.

Reference numeral 12 designates a shifter. The shifter 12 has cam followers 25 fixed thereto and each of the cam followers 25 comes in contact with the beam 20 whereby the shifter 12 is supported on the beams 20. Further, the shifter 12 is equipped with DC motor 13 of which shaft is fitted with a pinion 15 which is adapted to be engaged with the rack 14. As shown in FIGS. 2 to 4, The shifter 12 is provided with a plurality of pushers 16 and disc-shaped stoppers 19 which are operatively mounted on a support shaft 17 with the use of a key 18. Each of the pushers 16 is so designed that it has a single pawl 16*a* on the outer periphery of the disc. The pawl on the pushers 16 extends in the radial direction and both the ends of the shaft 17 are supported on the shifter 12 so that the former rotates on the latter.

A pair of carriers comprising pusher 16, stopper 19, support shaft 17 and key 18 are provided with the heads 2 being interposed therebetween. Incidentally, the same number of pushers as the heads 2 are provided.

The support shaft 17 includes a pulley 26 at the one end thereof which is operatively connected to a pulley 21 on the shaft of DC motor 23 via a timing belt 24 so that rotation of DC motor 23 is transmitted to the support shaft 17. A pulley 22 is so disposed that the timing belt 24 does not contact the shaft 1.

Next, operation of the apparatus will be described below

In the case where all six heads 2 on the driving side B are displaced to the controlling side A, the DC motor 23 rotates so as to rotate the support shaft 17 via the pulley 21, timing belt 24 and pulley 26. The pawl 16*a* of the pusher 16 located closest to the frame 4 on the driving side among the plural pushers 16 on the shifter is indexed at the position where it contacts the head 2. On the other hand, the head 2 located on the foremost end on the controlling side A comes in contact with the stopper 19 so that the head 2 is clamped between the stopper 19 and the pusher 16 (see FIG. 3).

Next, when DC motor 13 mounted on the shifter 12 is rotated, the pinion 15 is rotated while meshing with the rack 14 whereby the shifter 12 displaces six heads 2 toward the controlling side A with the aid of the pusher 16.

When the shifter 12 reaches a first predetermined position, rotation of DC motor 13 is interrupted and thereby movement of the shifter 12 is interrupted. At this moment a group of heads 2 tend to overrun under the effect of inertia movement thereof but overruning is inhibited by means of the stopper 19 located forwardly of the foremost head. When DC motor 13 stops its rotation, forcible braking is effected under the function of generator, resulting in the shifter 12 and the heads 2 being stopped more reliably.

Next, when DC motor 23 is rotated, the pawl 16*a* of the pusher 16 is indexed at the position where it contacts the head 2 to be set next. At this moment the pawl 16*a* of the pusher 16 which has contacted the first head 2 is simultaneously parted away from the head. By rotating DC motor 13 again, the residual heads 2 are displaced to the next setting position as a group.

By repeating the above-mentioned operations, a number of heads 2 are successively set to their pretermined position. It should be noted that rotation of DC motors 13 and 23 is controlled by means of a control unit which is not shown in the drawings.

As described above, according to the present invention inertia movement of the heads can be completely inhibited by displacing the heads while holding the heads between the stopper and pusher. In consequence, a speed of displacing of the shifter can be increased and moreover setting time can be reduced remarkably.

We claim:

1. An apparatus for determining positions of a plurality of heads slidably disposed on a shaft, comprising:

a shifter means for displacing the heads as a group by pushing them from a rear side of the group, the shifter means moving parallel to the shaft and parting away from the shifter one head at the rear side of the group when the shifter reaches a predetermined position, the shifter means comprising a carrier comprising a support shaft rotatably supported on a shifter housing, rotational means mounted on the shifter housing for rotating said support shaft, a plurality of pushers each fitted onto the support shaft and corresponding to a respective head whereby each pusher includes a pawl means for engaging its corresponding head and wherein the pawl means of each of the pushers are offset in a phased array from the pawl means of adjacent pushers whereby only one pawl is positioned for engagement with the one head at the rear side of the group at any one time, and, a circular plate-shaped limiting means for limiting forward displacement of a head at a forward end of the group of heads as the group is being displaced, said limiting means being mounted at a forwardmost end of the support shaft for engaging the head at the forward end of the group of heads.

2. An apparatus according to claim 1 wherein the shifter means comprises a carrier disposed on each side of the group of heads.

* * * * *